US005167460A

United States Patent [19]

Kikukawa

[11] Patent Number: 5,167,460

[45] Date of Patent: Dec. 1, 1992

[54] INFORMATION PROCESSING APPARATUS HAVING INTERCHANGEABLE TYPE ELEMENTS AND A DISPLAY FOR INDICATING THE TYPE STYLE OF A TYPE ELEMENT

[75] Inventor: Noriyuki Kikukawa, Yokohama, Japan

[73] Assignee: Canon Kabushiki Kaisha, Tokyo, Japan

[21] Appl. No.: 617,937

[22] Filed: Nov. 26, 1990

Related U.S. Application Data

[63] Continuation of Ser. No. 474,671, Feb. 6, 1990, abandoned, which is a continuation of Ser. No. 194,185, May 16, 1988, abandoned, which is a continuation of Ser. No. 912,152, Sep. 24, 1986, abandoned, which is a continuation of Ser. No. 701,655, Feb. 14, 1985, abandoned, which is a continuation of Ser. No. 495,712, May 18, 1983, abandoned.

[30] Foreign Application Priority Data

Jun. 2, 1982 [JP] Japan ..... 57-93073

[51] Int. Cl.[5] ..... B41J 1/30

[52] U.S. Cl. ..... 400/175; 400/83; 400/144.2

[58] Field of Search ..... 400/54, 83, 144.2, 171, 400/174, 175, 664, 703

[56] References Cited

U.S. PATENT DOCUMENTS

| | | | |
|---|---|---|---|
| 4,074,798 | 2/1978 | Berger | 400/144.3 |
| 4,209,262 | 6/1980 | Savage | 400/144.2 |
| 4,382,702 | 5/1983 | Fessel | 400/175 |
| 4,388,010 | 6/1983 | Mott et al. | 400/692 |
| 4,389,129 | 6/1983 | Sugiura | 400/54 |
| 4,428,694 | 1/1984 | Rager | 400/175 |
| 4,448,555 | 5/1984 | Hasegawa | 400/144.2 |
| 4,580,916 | 4/1986 | Rolfo et al. | 400/83 |
| 4,872,773 | 10/1989 | Ueda | 400/171 |

FOREIGN PATENT DOCUMENTS

| | | | |
|---|---|---|---|
| 55-48626 | 4/1980 | Japan . | |
| 2044969 | 10/1980 | United Kingdom | 400/703 |

OTHER PUBLICATIONS

C. E. Boyd et al; "Universal Control Providing a Variety of Character Fonts . . . "; *IBM Tech Disc Bull;* vol. 21, No. 9, pp. 3470–3480; Feb. 1979.

M. H. Kane; "Means for Identifying One of a Plurality of Impact Printer Print Wheels"; *IBM Technical Disclosure Bulletin;* vol. 22, No. 11, pp. 4795–4796; Apr. 1980.

Eliezer et al; "Key Identification System"; *IBM Tech. Disc. Bull;* vol. 19, No. 5, pp. 1548–1549; Oct. 1976.

Cooper; "Electronic Typewriter Type-Font Coding"; *IBM Tech. Disc. Bull;* vol. 19, No. 11, p. 4242; Apr. 1977.

Boehm; "Changeable Character Display Keyboard"; *IBM Tech Disc Bull;* vol. 22, No. 4, pp. 1368–1371; Sep. 1979.

*Primary Examiner*—David A. Wiecking

*Attorney, Agent, or Firm*—Fitzpatrick, Cella, Harper & Scinto

[57] ABSTRACT

There is disclosed an electronic printing apparatus with a printing mechanism utilizing a type-font element integrally provided with plural printing types for printing characters and numerals, in which a detector identifies the kind of the typefont element, and a display unit indicates the printing style of the typefont element in response to the output signals of the detector.

3 Claims, 3 Drawing Sheets

FIG. 5A PICA

FIG. 5B ELITE

INFORMATION PROCESSING APPARATUS HAVING INTERCHANGEABLE TYPE ELEMENTS AND A DISPLAY FOR INDICATING THE TYPE STYLE OF A TYPE ELEMENT

This application is a continuation of application Ser. No. 474,671 filed Feb. 6, 1990, now abandoned, which is a continuation of application Ser. No. 194,185 filed May 16, 1988, now abandoned, which is a continuation of application Ser. No. 912,152 filed Sep. 24, 1986, now abandoned, which is a continuation of application Ser. No. 701,655 filed Feb. 14, 1985, now abandoned, which is a continuation of application Ser. No. 495,712 filed May 18, 1983, now abandoned.

BACKGROUND OF THE INVENTION

1. Field of the Invention

The present invention relates to an electronic printing apparatus, utilizing an interchangeable typefont element, such as an electronic typewriter or a word processor, and more particularly to such an electronic printing apparatus provided with display means capable of displaying characters and numerals entered into it.

2. Description of the Prior Art

Conventional electronic printing apparatus with an interchangeable typefont element such as an electronic typewriter or word processor usually uses plural typefont elements having different typing styles. For example a word processor can use typefont heads of different print sizes such as 10 points or 12 points, an the electronic typewriter can use, in addition to the standard typefonts such as elite and pica, a typefont element with Greek letters and various symbols.

In such electronic printing apparatus, for example disclosed in the British Patent Specification No. 2087115 published May 19, 1982, the operator can identify the printing pitch but cannot identify the printing style of that printing pitch, for example as pica or elite, unless the printing style is confirmed by the actual printing. Therefore, in case a typefont element different from the desired one is mounted in the apparatus, waste of a printing sheet will result or the operator has to effect trial printing prior to the actual printing.

SUMMARY OF THE INVENTION

The object of the present invention, in order to avoid the above-mentioned drawbacks of conventional electronic printing apparatus, is to provide an electronic printing apparatus provided with display means for reliably advising the operator of the typing style of the typefont element mounted in said apparatus.

The above-mentioned object can be achieved according to the present invention by such printing apparatus provided with detector means for detecting the kind of the typefont element, wherein the display style or the display mode of said display means is changed according to the output signal of the detector means.

BRIEF DESCRIPTION OF THE DRAWINGS

FIG. 5A and 5B are schematic views showing the function of the electronic printing apparatus of the present invention.

DETAILED DESCRIPTION OF THE PREFERRED EMBODIMENTS

Now the present invention will be explained in detail by an embodiment thereof illustrated in the attached drawings.

In the following description, as an example, an electronic typewriter utilizing a so-called daisy wheel typefont wheel will be explained.

Figure 1:
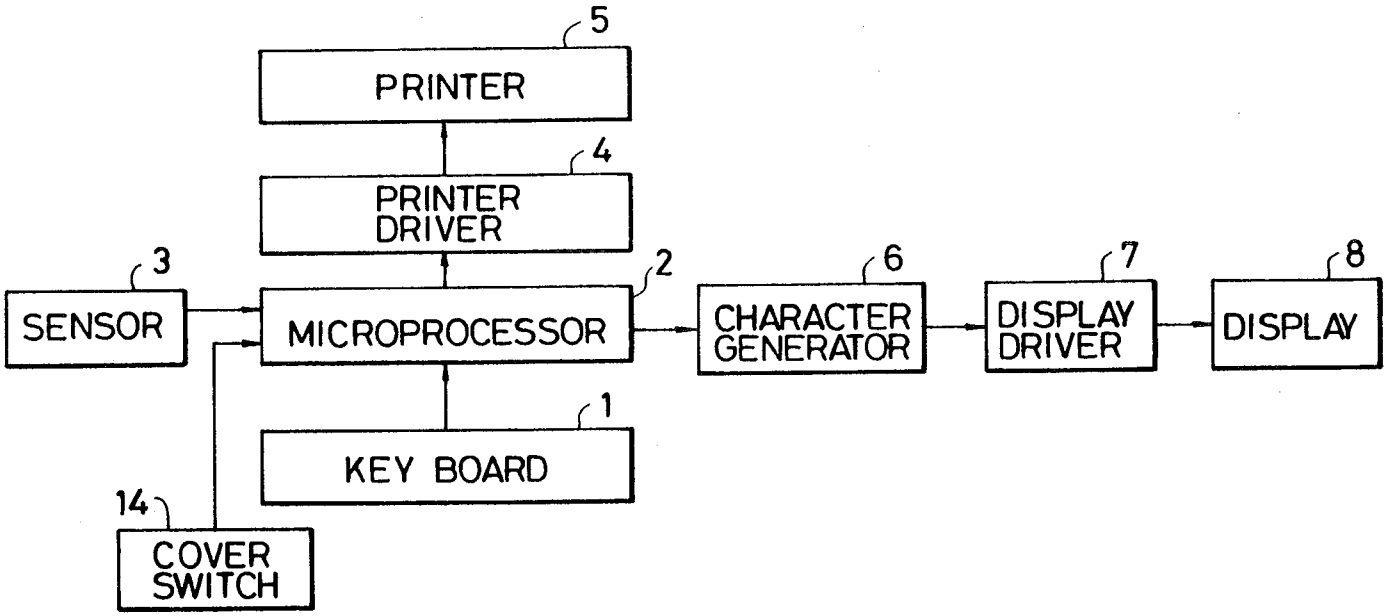
FIG. 1 is a block diagram showing the outline of a control circuit for use in the electronic printing apparatus of the present invention.

FIG. 1 shows the outline of the control circuit for use in the electronic printing apparatus of the present invention, wherein a keyboard 1 for entering characters, numerals and symbols to be printed is composed of a key matrix and is provided with character keys A–Z, numerals keys 0–9 and other function keys. The signals entered from said keyboard are supplied to a microprocessor (MPU) 2, which controls, through a printer driver 4, the amount of rotation of the daisy wheel typefont element provided in a printer 5 and the pressure of a printing hammer in order to achieve desired printing. The microprocessor 2 comprises a read-only memory ROM storing information for sequential control and a typing style table for converting the information relative to the species of the typefont element 9 to be entered from a typing style sensor 3 into information representing the typing style. The element 9 and sensor 3 are shown in at least one of FIGS. 2A and 2B. The microprocessor 2 also comprises a processing unit for data processing according to the information to be supplied from the read-only memory, registers for storing numerical data, adders for effecting the data processing and a control unit for effecting other controls.

In addition to the microprocessor 2, there is also is provided with a display control system composed of a character generator unit 6 and a display driver 7, whereby the character information entered from the keyboard 1 and transmitted by the microprocessor 2 is converted into dot information in a character generator of said character generator unit 6 and is displayed through the display driver 7 on a display unit 8 composed for example of a cathode ray tube or a liquid crystal display unit.

Furthermore the microprocessor 2 is connected to a sensor system provided with a typing style sensor 3 (FIG. 2B) for detecting the species of the typefont element and to cover a switch 14 (FIG. 3) for detecting the opening and closing of a cover that is opened and closed at the exchange of the typefont element as will be explained later.

Figure 2A:
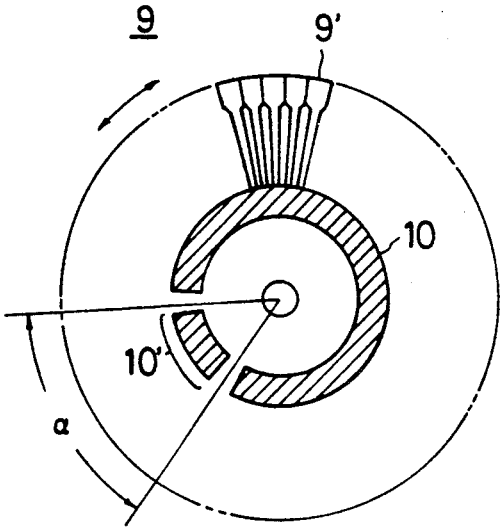
FIG. 2A is a schematic view showing the structure of a typefont element for use in the electronic printing apparatus of the present invention.
Figure 2B:
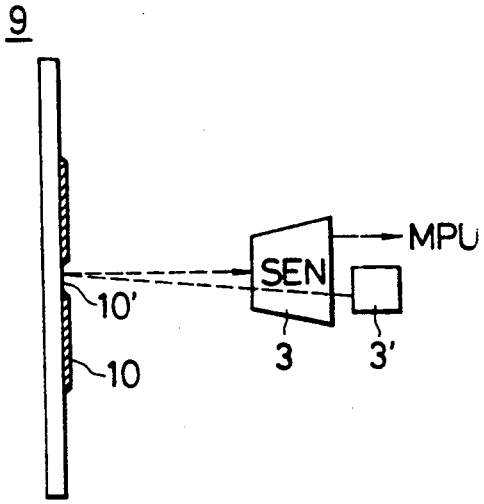
FIG. 2B is a lateral view showing elements for practicing the method of detecting the typing style of the typefont element in the electronic printing apparatus of the present invention.

FIGS. 2A and 2B show the daisy wheel typefont element 9 mentioned in the foregoing explanation and the method of element identification by the typing style sensor 3.

As shown in FIG. 2A the typefont element or unit 9 has a so-called daisy wheel structure in which a circular rim is provided with plural radial spokes made of a flexible material such as plastic material, and a printing type 9' is integrally provided on the outer end of each of the spokes. On the rim of the typefont element 9 there is adhered a non-reflecting black tape 10 or the like, which is provided with cut-off portions mutually separated by an angle $\alpha$ representing the typing style or species of the typefont element 9. The angle $\alpha$ and the species of the typefont element may for example be related to each other in a manner shown in the following Table 1:

TABLE 1

| Angle ($\alpha$) | Typing style |
|---|---|
| 45° | Pica |
| 90° | Elite |
| 135° | Greek characters |
| 180° | Italic |
| . | . |
| . | . |
| . | . |

In the above-described example the angle $\alpha$ is selected as a multiple of 45° corresponding to each typing style, and the cut-off portions are detected, as shown in FIG. 2B, by a light emitted from a light source 3' and received by a typing style sensor 3 composed for example of a CdS sensor. The above-explained table is stored, in the form of digital information, in the read-only memory of the microprocessor processor 2, whereby the microprocessor is capable of detecting the species of the typefont element 9.

Figure 3:
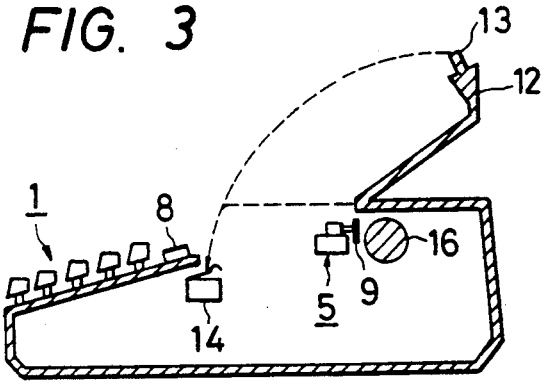
FIG. 3 is a schematic cross-sectional view of the electronic printing apparatus of the present invention.
Figure 3:
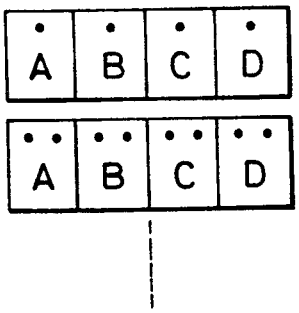

FIG. 3 shows the structure of the cover switch 14 FIG. 3 is a schematic cross-sectional view of the electronic printing apparatus of the present invention, wherein the keyboard 1 is provided on an inclined upper face positioned at left closer to the operator. Beyond the keyboard there is provided a cover 12 which can be opened and closed for exchanging the typefont wheel 9 which is positioned facing a platen 16, and the cover switch 14 is provided inside the printing apparatus in such a manner as to be actuated by a projection 13 provided at the front end of said cover 12. In the present embodiment it is assumed that the switch 14 is closed when said cover is closed.

The function of the above-described embodiment will now be explained with reference to FIG. 4.

After the start of power supply to the apparatus, the microprocessor 2 reads, in a step S1, the angle $\alpha$ of the cut-off portions 10' of the typefont wheel 9 and, in a step S2, identifies the species of the mounted typefont wheel 9 from the typing style table and supplies the obtained information to the character generator unit 6.

In a step S3 the microprocessor 2 checks the state of the cover switch 14, and, if it is turned on by the closed cover 12, enables key entry from the keyboard 1 in a step S5. In a subsequent step S6 the microprocessor 2 transmits the character information entered by the operator from the keyboard 1 to the character generator unit 6, which causes the display unit 8, which may be such as a cathode ray tube, to display the entered characters through the display drier 7 in a typing style such as pica or elite according to the typing style information previously sent from the microprocessor 2.

Consequently the operator can easily confirm the species of the mounted typefont element from the display on the display unit 8.

In case step S3 identifies the opened state of the over 12 indicating that the operator is exchanging the typefont element 9, key entry is not enabled and the program returns to the step S1 after the cover switch 14 is turned on by the closing of the cover 12 in a step S4. In the foregoing embodiment there is employed a display unit of a high resolving power such as a cathode ray tube, but in the case where a display unit is employed having a lower resolving power, not sufficient for displaying the typing style, such as a liquid crystal display unit, it is also possible to display the typing style of the mounted typefont wheel. This indication may be related to the number of dots displayed as shown in FIGS. 5A and 5B, wherein one dot on the displayed character indicates pica style while two dots on the displayed character indicated elite style. It is also possible, instead of changing the typing style displayed on the display unit, to indicate the typing style in a corner of the display unit or to display the typing style for example by indicator means provided on the keyboard.

Although the typefont element in the foregoing description is assumed to be of a so-called daisy wheel type, the present invention is naturally applicable also to other types of the typefont elements.

As explained in the foregoing, the present invention is featured by detecting means for detecting the species of the mounted typefont element and by changing the typing style or display mode on the display means to indicate the typing style of the mounted typefont element. The electronic printing apparatus of the present invention can therefore reliably inform the operator of the typing style of the mounted typefont element, thereby eliminating erroneous operation or trial printing operation which has been necessary with conventional electronic printing apparatus with interchangeable typefont elements.

What I claim is:

1. A printing apparatus comprising:

a type font assembly unit, detachable from the printing apparatus, comprising a doughnut-like member, said member having two optically distinct portions and being attached to a type font assembly unit body in coaxial alignment therewith, the arc between the two optically distinct portions defining a center angle representative of the kind of type font of the type font assembly unit means for discriminating the kind of type font in said mounted type font assembly unit by detecting the center angle defined by said doughnut-like member;

means for displaying input recording characters inputted into the printing apparatus, said displaying means displaying the input recording characters in a font style discriminated by said discriminating means; and printing means for printing the inputted recording characters in the font style of the type font assembly unit.

2. A printing apparatus according to claim 1, wherein said type font assembly unit is a daisy wheel type font assembly unit and said discriminating means detects the center angle by rotating said daisy wheel type font assembly unit.

3. A printing apparatus comprising:

a type font assembly unit, detachable from the printing apparatus, comprising a doughnut-like member, said member having two optically distinct portions, and being attached to a type font assembly unit body in coaxial alignment therewith, the arc between the two optically distinct portions defining a center angle representative of the kind of type font of the type font assembly unit;

means for discriminating the kind of type font in said mounted type font assembly unit by detecting the center angle defined by said doughnut-like member;

means for displaying input recording characters inputted into the printing apparatus, said displaying means displaying the input recording characters in a font style discriminated by said discriminating means;

printing means for printing the inputted recording characters in the font style of the type font assembly unit; and means for changing over the kind of font to be displayed on said display means according to the discriminated king of type font.

* * * * *

UNITED STATES PATENT AND TRADEMARK OFFICE

CERTIFICATE OF CORRECTION

PATENT NO. : 5,167,460 Page 1 of 2

DATED : December 1, 1992

INVENTOR(S) : NORIYUKI KIKUKAWA

It is certified that error appears in the above-identified patent and that said Letters Patent is hereby corrected as shown below: Title page: item

[56] REFERENCES CITED

FOREIGN PATENT DOCUMENTS

Insert the following

| | | |
|---|---|---|
| --55-76630 | 5/13/82 | Japan |
| 53-48435 | 1/5/78 | Japan |
| 52-91615 | 2/8/77 | Japan |
| 56-162788 | 12/14/81 | Japan |

OTHER PUBLICATIONS

Under "C.E. Boyd et al;", "pp. 3470-3480" should read --pp. 3479-3480;--.

SHEET 3 OF THE DRAWINGS

Figure 4:
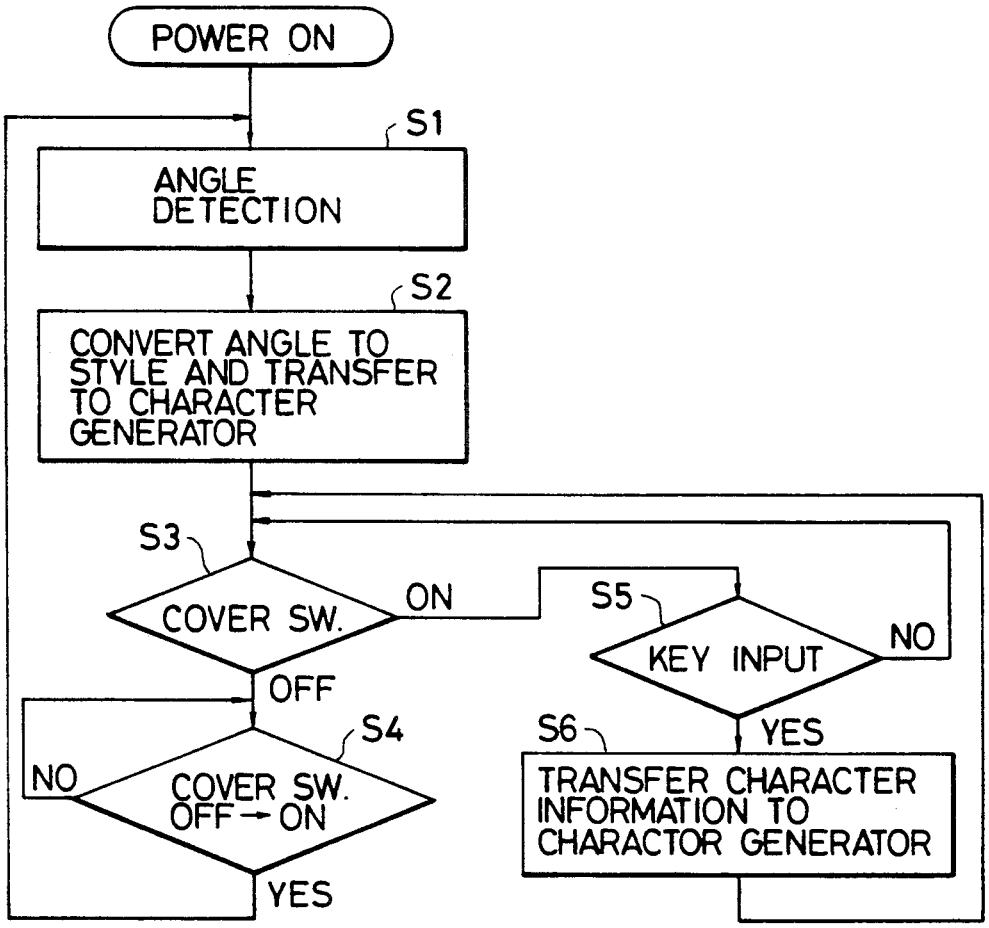
FIG. 4 is a flow chart showing the function of the electronic printing apparatus of the present invention.

Figure 4, "CHARACTOR" should read --CHARACTER--.

COLUMN 1

Line 31, "an the" should read --and an--.
Line 40, "the" should be deleted.

COLUMN 2

Line 42 "is" (second occurrence) should be deleted.
Line 43, "with" should be deleted.

UNITED STATES PATENT AND TRADEMARK OFFICE

CERTIFICATE OF CORRECTION

PATENT NO. : 5,167,460

DATED : December 1, 1992

INVENTOR(S) : NORIYUKI KIKUKAWA

It is certified that error appears in the above-identified patent and that said Letters Patent is hereby corrected as shown below:

COLUMN 3

Line 28, "14" should read --14.--.
Line 55, "such as" should be deleted.
Line 57, "drier" should read --driver--.
Line 60, "Consequently" should read --Consequently,--.

COLUMN 4

Line 10, "indicated" should reads --indicates--.

Signed and Sealed this

Thirtieth Day of November, 1993

Bruce Lehman

*Attest:*

BRUCE LEHMAN

*Attesting Officer*

*Commissioner of Patents and Trademarks*